US005247772A

United States Patent [19]

Greenberg

[11] Patent Number: 5,247,772

[45] Date of Patent: Sep. 28, 1993

[54] STANDING SEAM ROOFING PANEL

[75] Inventor: Percy Greenberg, St. Louis Park, Minn.

[73] Assignee: Crown Partnership, Minneapolis, Minn.

[21] Appl. No.: 927,842

[22] Filed: Aug. 10, 1992

Related U.S. Application Data

[63] Continuation-in-part of Ser. No. 786,033, Oct. 31, 1991, abandoned.

[51] Int. Cl.[5] ..... E04D 1/00

[52] U.S. Cl. ..... 52/531; 52/545; 52/528

[58] Field of Search ..... 52/531, 545, 394, 747, 52/537, 539, 588, 528

[56] References Cited

U.S. PATENT DOCUMENTS

| | | | |
|---|---|---|---|
| 372,589 | 11/1887 | Andrews | 52/528 |
| 396,605 | 1/1889 | Sagendorph | 52/528 |
| 403,899 | 5/1889 | Abrahams | 52/528 |
| 1,292,960 | 1/1919 | Owens | 52/528 |
| 3,135,070 | 6/1964 | Waring et al. | 52/531 |
| 3,399,916 | 9/1968 | Ensor | 52/588 |
| 3,495,363 | 2/1970 | Johnson | 52/531 |
| 4,091,588 | 5/1978 | Heirich | 52/588 X |
| 4,109,437 | 8/1978 | Player | 52/588 X |
| 4,266,385 | 5/1981 | Oehlert | 52/588 X |
| 4,495,743 | 1/1985 | Ellison | 52/478 |
| 4,878,331 | 11/1989 | Taylor | 52/519 |
| 5,038,543 | 8/1991 | Neyer | 52/588 X |
| 5,140,793 | 8/1992 | Knudson | 52/588 X |

*Primary Examiner*—Carl D. Friedman
*Assistant Examiner*—Beth A. Aubrey
*Attorney, Agent, or Firm*—Nawrocki, Rooney & Sivertson

[57] ABSTRACT

A standing seam roofing panel having opposed elevated ridges to define first and second dikes. The roofing panel includes a ledge integrally formed with the panel and extending from the first dike to a first panel edge for securing the roofing panel. The second dike includes a cap integrally formed therewith having a free end which is releasably secured over the first dike of an adjacent roofing panel to secure adjacent panels and seal the standing seam.

11 Claims, 3 Drawing Sheets 70
71
72
73
20A
25A
65A
85
50A
70A
55A
15'A
17A
45
15A
35
40
30
15''A

STANDING SEAM ROOFING PANEL

This is a continuation-in-part of application Ser. No. 07/786,033, filed Oct. 31, 1991 now abandoned.

BACKGROUND OF THE INVENTION

The present invention relates to roofing systems and in particular to a standing seam roofing panel.

Standing seam roofing systems are known and are particularly suited for commercial applications. In a standing seam roof, the edges of the roof-forming panels are folded or bent to form a dike. The dikes of adjacent panels define a raised or standing seam. The standing seam reduces water seepage from the surface of the roofing panels to provide a drier roofing structure. Additionally, the standing seam reduces exposure of the roofed surface to other harmful effects.

Standing seam roofing panels are typically joined and secured to the roofed surface by a clip. Typical clips include a base which is secured to the surface to be roofed, as by screwing or nailing, and clipping wings which are folded down over the folded/bent edges of adjacent roofing panels. During installation, each clip is secured to the surface to be roofed with the bent edges (dikes) of adjacent panels aligned relative to the clipping wings. The wings are then folded over the bent edges to secure the roofing panels. A cap is used to cover the standing seam between adjacent panels to seal the roofed surface at the seam.

SUMMARY OF THE INVENTION

The present invention provides a standing seam roofing panel. Elevated ridges along first and second opposed sides thereof define dikes which form a standing seam between adjacent roofing panels. A ledge is integrally formed with the panel and extends from a first dike to its associated edge at the first panel side. The ledge is used to secure the panel to a roofing surface, as by screwing or nailing, for example. A cap is formed integrally with a second dike and has a free end which is secured over the first dike of an adjacent roofing panel to secure the second side of the panel to the roofed surface and seal the seam between them. Accordingly, when first and second dikes of adjacent panels are arranged to form a roofing construction, the ledge (and any fastening devices, such as screws) of one panel is covered by the adjacent panel while the cap of the adjacent panel seals the standing seam between them. Thus, there is provided a roofing construction having all of the advantages of prior art standing seam roofs but which eliminates the need for separate clips and seam caps.

DETAILED DESCRIPTION OF THE PREFERRED EMBODIMENTS

Figure 1:
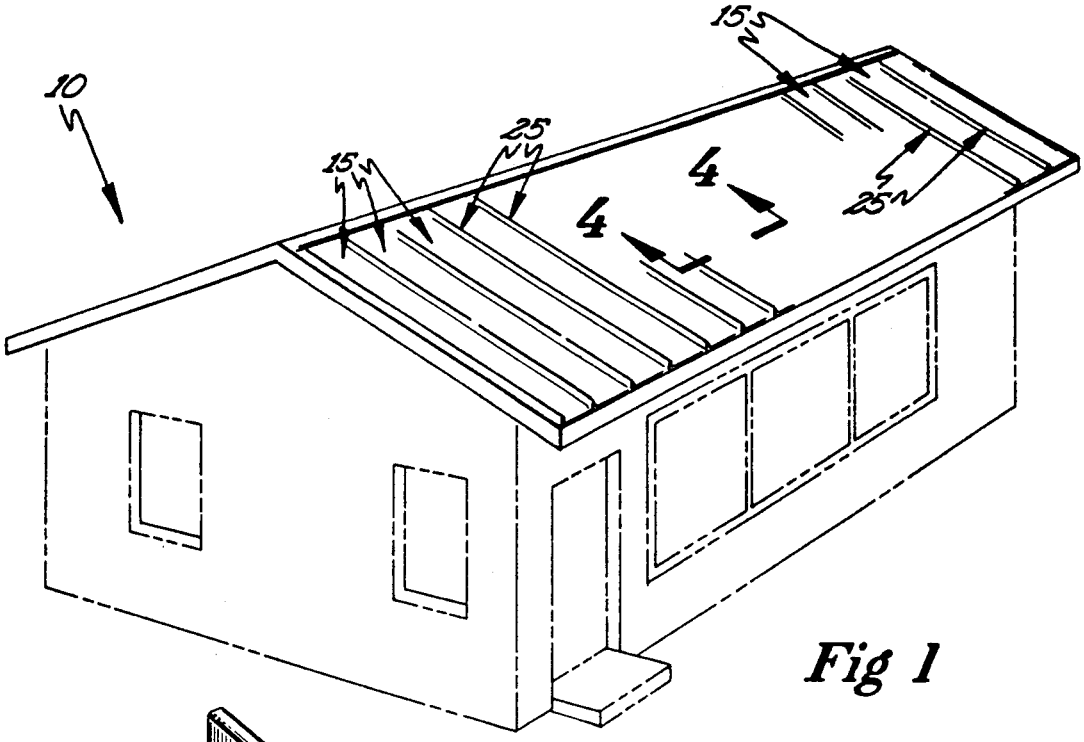
FIG. 1 is a perspective view of a building illustrating the standing seam roofing panels of the present invention assembled to form a continuous roofing structure.
Figure 2:
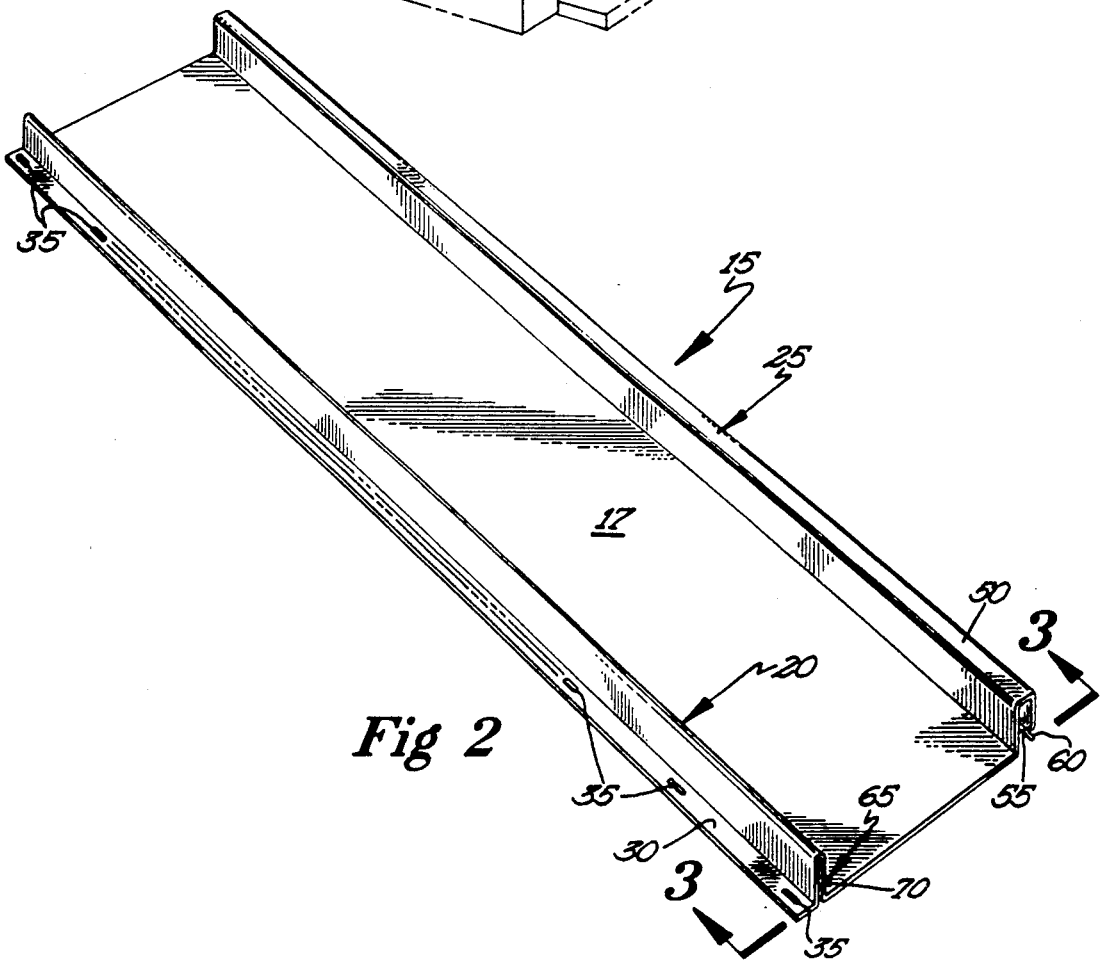
FIG. 2 is a perspective view of a first embodiment of a roofing panel in accordance with the present invention.
Figures 3, 4:
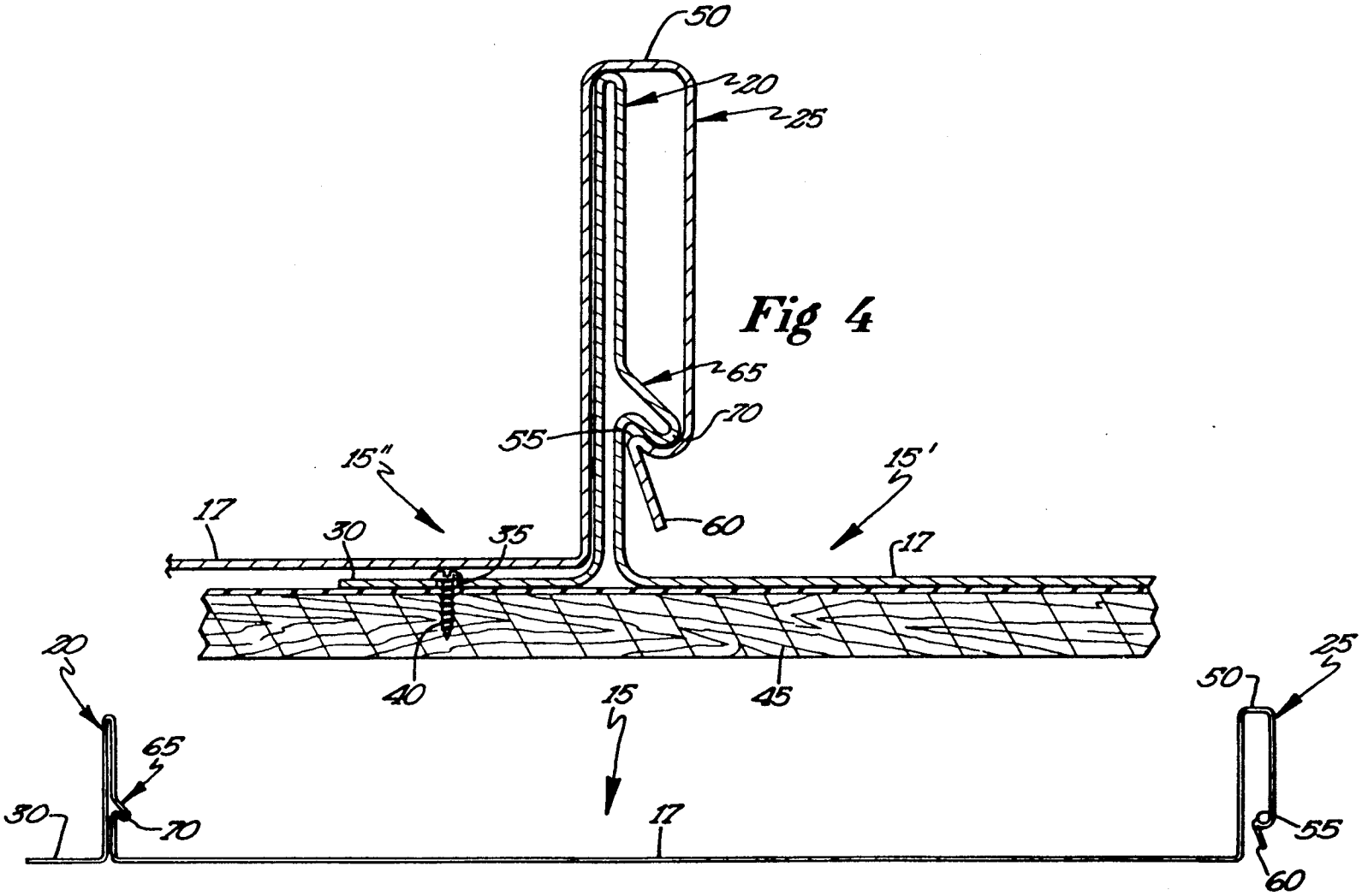
FIG. 3 is an elevational view of a roofing panel of the first embodiment as taken along line 3—3 of FIG. 2.
FIG. 4 is a detailed sectional view of consecutive roofing panels of the first embodiment as taken along line 4—4 of FIG. 1.

FIG. 1 illustrates a building 10 having a standing seam roofing structure formed of a plurality of roofing panels 15 in accordance with the present invention. FIGS. 2–4 illustrate a first embodiment 15 of the roofing panel.

As shown in FIGS. 2 and 3, the roofing panel 15 is an elongated sheet 17, which when applied to a surface to be roofed provides a protective covering. The roofing panel 15 includes a first dike 20, a second dike 25 and a ledge 30. The first dike 20 is formed of an elevated ridge which extends along a first side of the panel 15. The ledge 30 extends from the first dike 20 to the edge of the first side of the panel 15. That is, the ledge 30 is positioned between the edge of the first side and the first dike 20. The second dike 25 is formed of an elevated ridge which extends along a second opposed side of the panel 15.

The ledge 30 includes a plurality of elongated fastener slots 35 designed to receive fasteners 40. The fasteners 40 secure the first side of the panel 15 to the roofed surface 45. Preferably, the elongated fastener slots 35 are spaced so that the center of adjacent slots 35 are one and one-half inch (1½ inch) apart (FIG. 2). Washers (not shown) may be used with the fasteners 40 to facilitate shifts between the roofed surface 45 and the panels 15 after construction. Such shifts will occur from expansion as a result of different coefficients of expansion between the panel 15 and the surface 45, and the washers will reduce wear and prolong the life of the roof. The washers may be made of Teflon, Nylon or similar plastics to reduce friction and further facilitate expansion shifts. Alternatively, the washer or head of the screw may be coated with such a low friction material, or a galvanized finish. In general the use of dissimilar materials, including dissimilar metals, for the panel and the engaging surface of the fastener or washer will facilitate sliding movement and shifting of the panel.

Figures 5, 6, 7:
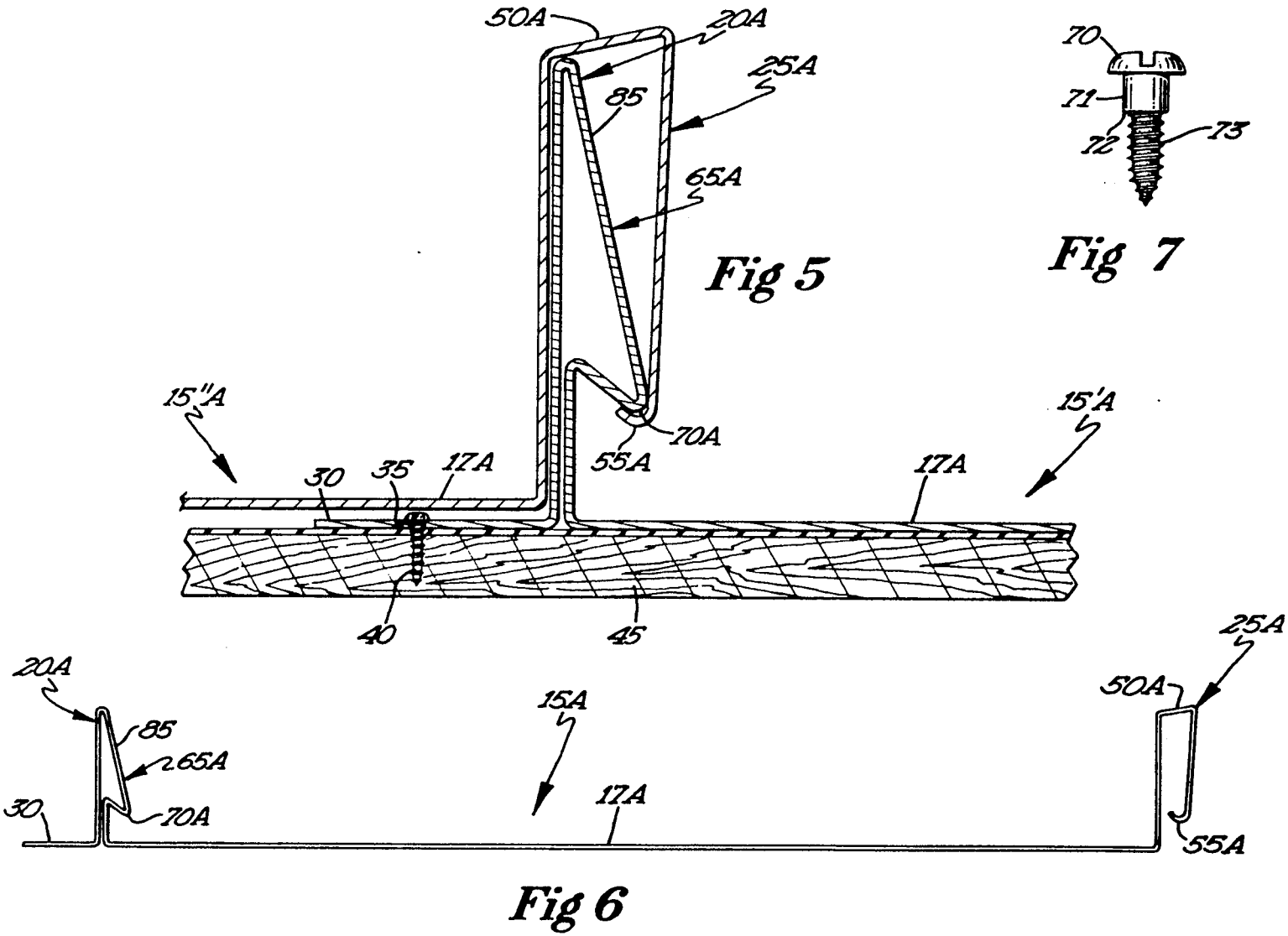
FIG. 5 is a cross-sectional view of consecutive roofing panels, similar to FIG. 4, of a second embodiment in accordance with the present invention.
FIG. 6 is a side elevational view of the second embodiment of the roofing panel of the present invention, similar to FIG. 3.
FIG. 7 is a side view of a fastener which may be used to advantage in conjunction with a roofing panel in accordance with the present invention.

In accordance with the present invention, shoulder or shouldered screws may be employed as the fasteners 40. Such fasteners include a head 70, shank 71 and a shoulder 72 as shown in FIG. 7. A screw portion 73 extends from the shoulder 72, in known manner. In use, the shank 71 extends through the slots 35 with the shoulder 72 abutting against the surface 45, the surface 45 being engaged by the screw portion 73. The length of the shank 71 is selected to provide a space between the roof surface and the screw head 70 such that the freedom of movement of the panel 15 is assured. That is, with a conventional screw, as shown in FIGS. 4 and 5, that screw may be advanced too far into the surface 45 such that the freedom of movement of the panel 15 is overly restricted. With such conventional fasteners, great care must be taken during installation. With a shoulder screw, as shown in FIG. 7, a proper relationship between the fastener head 70 and the panel 15 is maintained. For this purpose, the shank 71 should be slightly longer (10 thousandths of an inch, for example) than the thickness of the panel 15 such that the panel 15 is retained on the surface 15 while being allowed to shift along the surface 15. In this manner, panel 15 is less likely to be damaged by expansion and contraction due to changing temperature. Washers may be employed with the shoulder screw, in which case the shank 71 is longer to accommodate the washer thickness. A low friction coating may be employed, such as Teflon, Nylon, etc., or even a galvanized finish to the head 70 of the fastener (or the entirety of the fastener) and/or to any washer. Again, the use of dissimilar materials, including dissimilar metals, for the panel and the engaging surface of the fastener or washer will facilitate sliding movement and shifting of the panel.

The ledge 30 provides a convenient point for attachment of the panel 15 to the roofed surface 45. Ledge 30 is especially provided for fastening to the roofed surface 45. Ledge 30 provides an extension to the panel so that the fasteners can be placed in fastener slots in ledge 30 without interfering with or obstructing any other portion of the panel 15. Moreover, the ledge 30 is designed to be covered by an adjacent panel 15. Liquid therefore cannot leak through the fastener slots in the ledge 30, in that those slots are not exposed and the integrity of the roofing surface is preserved.

As shown more clearly in FIGS. 3 and 4, the elevated ridge of the second dike 25 is integrally formed of a U-shaped cap portion 50 having a free end. The free end of the U-shaped portion is "hooked" to define a flexible latching lip 55 and has a sloped shaped member 60 extending from the lip 55 to form a latch operator 60.

The elevated ridge of the first dike 20 is generally perpendicular to the panel 15 and has a sloped protrusion (sloped towards a panel surface) defining a latching post 65. A rounded end of the sloped protrusion defines a latch base 70 for the latching post 65. Preferably, the protrusion is sloped at approximately a 45° angle towards the panel 15 surface. The latching post 65 and the latching lip 55 are axially aligned on the first and second dikes 20 and 25, respectively, so that the latching posts 65 and latching lips 55 of adjacent panels can be joined. The latching lip 55 (hook) and latch base 70 are contoured to form a tight engagement and lock adjacent roofing panels to each other.

As shown in FIG. 4, a first roofing panel 15' is secured to the roofed surface 45 by fasteners 40 along the ledge 30. A second roofing panel 15'' is joined to the first roofing panel 15' by fitting the cap 50 (flexible "U" shaped portion) of the roofing panel 15'' over the first dike 20 of the roofing panel 15'. As the cap 50 is forced over the first dike 20, the sloped surface of the latch operator 60 engages the surface of the latching post 65 to flex the cap 50 and latching lip 55 open and past the latch base 70 of the latching post 65. The flexible cap 50 snaps shut to hook the latching lip 55 about the latch base 70 to secure the roofing panels to join and seal the raised or standing seam formed between the first and second dikes of consecutive panels.

As described a first side of the panel 15' is secured to the roofing surface at the ledge. In assembling the roofing construction, an adjacent roofing panel 15'' covers the ledge 30 to shield the elongated fastener slots 35 (and any holes in the surface to be roofed resulting from the fasteners 40) from the environment. Consecutive panels are joined at the dikes by the cooperating latching lip and latch base of adjacent panels which also secures the second side of the adjacent panel (15'') to the roofed surface in cooperation with the attachment of the ledge 30 of the original panel (15') to the roofing surface. Thus, the integral ledge directly secures the first side of a roofing panel and functionally secures the second side of an adjacent panel without using clips to assemble consecutive panels.

Preferably, the panels 15 are formed from a continuous sheet of metal and bent to form the ridges (dikes) and ledges. Alternately, the panels 15 may be formed of plastic or fiber glass. The "downward" (toward the panel) projection of the latching post 65 prevents capillary movement of water up the wall of the dike 20. The panel materials and their dimensions, including thickness, correspond to those of conventional standing seam roofing panels.

FIGS. 5 and 6 illustrate an alternate embodiment 15A of a standing seam roofing panel in accordance with the present invention. Like numbers have been used to identify corresponding parts of the first embodiment as illustrated in FIGS. 1–4. As shown in FIG. 6, the roofing panel 15A is formed of an elongated sheet 17A and includes a first dike 20A and a second dike 25A and a ledge 30A (having fastener slots 35A therealong). The first and second dikes 20A and 25A are also formed of elevated ridges along first and second sides, respectively of the elongated sheet 17A and the ledge 30A extends from the first dike 20A to an edge of the first side of the panel 15A.

As shown in FIGS. 5 and 6, the elevated ridge of the first dike 20A is formed of a nose shaped extension defining a sloped surface 85 and a "V" shaped latch base 70A to form the latching post 65A.

Similar to the roofing panel 15 of the first embodiment, the elevated ridge of the second dike 25 is formed of a flexible "U"-shaped cap 50A integral with the second dike 25A. A free end of the flexible "U" shaped portion has a "hooked" shape portion defining a latching lip 55A. A lower surface of the latching lip 55A functionally defines the latch operator 60A.

The latching lip 55A (hook) engages the "V" shaped latch base 70A of an adjacent roofing panel to join those panels. In particular, as previously explained with respect to the first embodiment, adjacent roofing panels 15'A and 15''A are joined by fitting the cap 50A of the roofing panel 15''A over the nose shaped extension of the roofing panel 15'A. As the cap 55A is forced over the first dike 20A of panel 15'A, the lower surface of the latching lip 50A engages the sloped surface 85 of the nose shaped extension (dike 20A) to flex the cap 50A around the "V" shaped latch base 70A. At the latch base 70A the flexible latching lip (hook) 55A of cap 50A releases to snap fit the latching lip of the panel 15''A in engagement with the latch base 70A to define a secure attachment for panels 15'A and 15''A.

The characteristic geometry of the dikes 20, 25 and 20A and 25A are shown in FIGS. 4 and 5, respectively. As shown, the dikes 20 and 20A are integrally formed by bending the panel along one side (the left of panels 15 and 15'A in the view of FIGS. 4 and 5) to form a first upstanding leg. The ledge 30 is also formed by bending and extends between the upstanding leg of dikes 20 and 20A to the edge of the panel. In the illustrated embodiments, the dikes 20 and 25 are bent to include a depending leg, generally perpendicular to the face surface of the panel between the upstanding leg and the ledge 30. Similarly, the dikes 25 and 25A are integrally formed by bending the panel along the other side of the panel (the right of the panels 15'' and 15''A, the views of FIGS. 4 and 5) to form a second upstanding leg. A cap is integrally formed with the second upstanding leg (again by bending) and has a depending leg having a free end. The free end cooperates with a latching post 65 and 65A of the dikes 20 and 20A to form a latch which secures the cap of one panel over the seam or gap between the dikes of adjacent panels. Further, the height of the first upstanding leg is greater than the height of the second upstanding leg. Thus, when the cap is positioned over the first upstanding leg of an adjacent panel, the greater length of the first upstanding leg spaces the panel portion overlying the ledge from the ledge. Preferably, this spacing is sufficient to prevent contact between the fasteners in the ledge and the overlying panel portion such that read through of the fastener head in that panel portion is prevented. Typically, it is expected that the spacing between the ledge and overlying panel portion will be ⅛ inch.

Although the present invention has been described with reference to preferred embodiments, workers skilled in the art will recognize that changes may be made in form and detail without departing from the spirit and scope of the invention.

What is claimed is:

1. In a standing seam protective roof covering of the type wherein the seam between adjacent roof panels is formed between generally parallel first and second integrally formed, upstanding, dike-forming legs extending generally perpendicular to the panel along opposing sides thereof and sealed by a cap, the improvement wherein the cap is integrally formed with the second of said legs and is adapted to extend over the seam between the first and second legs of adjacent panels and over the first leg of an adjacent panel and having a depending leg with a free end, and comprising ledge means integrally formed with the panel and extending between the first upstanding leg to a first panel edge to underlie an adjacent panel; the first upstanding leg having a greater height than the second upstanding leg to space the panel from an underlying ledge of an adjacent panel; and further comprising latch means for securing the free end of the cap depending leg to the first upstanding leg, the ledge means including a plurality of elongated fastener slots for securing the ledge of the roofing surface while accommodating expansion of the panel.

2. The standing seam roofing panel of claim 1 wherein the means for releasably securing the free end of the cap to a first dike comprises:

a latching lip formed at the free end of the cap, the first dike including:

a latching post having a latch base adapted for engagement by the latching lip.

3. The standing seam roofing panel of claim 2 wherein the latching post includes a sloped surface adapted to flex the cap of an adjacent panel.

4. The standing seam roofing panel of claim 2 wherein the latching lip is a hook.

5. The standing seam roofing panel of claim 4 wherein the latching post is formed of a nose shaped member, the sloped surface of the nose shaped member by being adapted to engage the cap of an adjacent panel to flex the latching lip.

6. The standing seam roofing panel of claim 5 wherein the latch base is formed as a "V" shaped tip.

7. The standing seam roofing panel of claim 4 wherein the latching post is a downwardly sloped protrusion extending from the first dike.

8. The standing seam roofing panel of claim 7 wherein a tip of the sloped protrusion defines the latch base.

9. The standing seam roofing panel of claim 4 wherein the latch base is contoured to fit in close engagement with the latching lip.

10. The standing seam roofing panel of claim 4 wherein the hook curves upward about the latch base.

11. The standing seam roofing panel of claim 1 further comprising shoulder screw means adapted to secure the ledge means through the elongated fastener slots.

* * * * *